US005609504A

United States Patent [19]

Cherry et al.

[11] Patent Number: 5,609,504

[45] Date of Patent: Mar. 11, 1997

[54] WIRE CONNECTOR WITH IMPROVED CLASP

[75] Inventors: Hitesh Cherry; Michael A. Kandros; Daniel V. Nardone, all of Harrisburg, Pa.

[73] Assignee: The Whitaker Corporation, Wilmington, Del.

[21] Appl. No.: 412,045

[22] Filed: Mar. 28, 1995

[51] Int. Cl.[6] ..... H01R 4/50

[52] U.S. Cl. ..... 439/783; 439/863

[58] Field of Search ..... 439/783, 863

[56] References Cited

U.S. PATENT DOCUMENTS

| | | | |
|---|---|---|---|
| 3,280,845 | 10/1966 | Broske et al. | 140/113 |
| 3,588,791 | 6/1971 | Polidori | 439/783 |
| 4,059,333 | 11/1977 | Mixon, Jr. | 339/247 |
| 5,006,081 | 4/1991 | Counsel et al. | 439/783 |
| 5,281,173 | 1/1994 | Cherry et al. | 439/783 |
| 5,340,336 | 8/1994 | Menechella | 439/783 |

*Primary Examiner*—Gary F. Paumen
*Assistant Examiner*—T. C. Patel

[57] ABSTRACT

A wire connector (10) is disclosed of the type having an outer clamp member (14) and an inner wedge (12) that is inserted into the clamp member to physically and electrically interconnect two conductors (16, 18) together. The clamp member (14) includes a resilient intermediate portion (60) having two walls (62, 64) attached at right angles thereto with opposing channels (66, 68) formed in the two walls. The wedge 12 is arranged to enter into the clamp member (14) and clamp the two conductors (16, 18) against the two channels (66, 68) A pair of flanges (72, 76) extend from the two walls toward each other and have flange surfaces (74, 78) that oppose bearing surfaces (50, 52) on the wedge. When conductors of a certain size combination are being interconnected the bearing surfaces (50, 52) pressingly engage the flange surfaces (74, 78) causing the walls (62, 64) to tend to move inwardly, thereby increasing the clamping force that is exerted on the conductors (16, 18).

9 Claims, 6 Drawing Sheets

WIRE CONNECTOR WITH IMPROVED CLASP

The present invention relates to electrical wire connectors for electrical distribution systems of the type having an outer clamping member and a wedge for interconnecting two or more wires.

BACKGROUND OF THE INVENTION

In the power distribution industry wire connectors are widely used to interconnect electrical equipment to power conductors without physically breaking or rerouting the power conductor. The wire connector usually consists of two parts, a C-shaped clamping member and a wedge. Such wire connectors are disclosed in U.S. Pat. Nos. 3,280,856 which issued Oct. 26, 1966 to Broske et al. and 3,349,167 which issued Oct. 24, 1967 to Mixon Jr. et al. A typical wire connector of more recent design is disclosed in U.S. Pat. No. 5,281,173 which issued Jan. 25, 1994 to Cherry et al. and which is incorporated herein by reference. The typical wire connector, as disclosed in the '173 patent, includes a clamping member having a pair of opposite rolled over edges forming opposing channels and a wedge that is conformably received within the two channels. The opposing channels are arranged for receiving two conductors such as power cables, wires, or in some cases a tap lug, with the wedge therebetween. The clamping member includes an intermediate or web portion between the two rolled over edges having a bight disposed laterally of the two channels and a double loop, one on each side of the bight. The clamping member is made of a spring material so that the bight and double loop provide resiliency, thereby allowing the two rolled over edges to expand as the wedge and conductors are forced into the channels, and to provide a clamping action against the conductors and wedge. The resiliency of the clamping member also allows for a limited range of conductor sizes to be accommodated in a given clamping member. However, the smaller size conductors expand the clamping member relatively little resulting in relatively little clamping force on the conductor, while the larger conductors have the opposite effect. This drastically reduces the actual range of conductor sizes that can be accommodated in a single clamping member and wedge combination. To cover a full range of conductor sizes from 14 gage to 397 circular mills a total of 59 different sized clamping member and wedge combinations are required. This, of course, requires that an inventory of these parts be maintained and made available to the worker in the field. The dimensions of the bight portion of the different clamping members are different so that several different power assist tools are required to handle all of the different clamping members.

What is needed is an electrical wire connector and mating wedge having the capacity for accommodating a large range of conductor sizes so that substantially fewer different parts need to be stocked. Additionally, each of the different wire connectors should be accepted by the same power assist tool.

SUMMARY OF THE INVENTION

An electrical wire connector is disclosed for electrically connecting two conductors together. The connector includes a clamp member and a wedge. The clamp member has a resilient intermediate portion with two inwardly facing opposed first and second channels formed in first and second walls, respectively. The walls extend from opposite sides of the intermediate portion. First and second flanges are attached to the first and second walls, respectively, opposite the intermediate portion. A wedge is provided having first and second opposite edges, a first bearing surface adjacent the first edge, and a second bearing surface adjacent the second edge. The wedge is arranged to be conformably received in a closed position between the first and second channels of the clamp member so that the first and second opposite edges are in opposed relationship with the first and second channels for clamping first and second conductors therebetween, respectively. In this position the first bearing surface is opposed to the first flange and the second bearing surface is opposed to the second flange. When moving the wedge into engagement with the first and second conductors and into the closed position within the clamp member, the first and second channels are cammed outwardly against the urging of the resilient intermediate portion so that the first conductor is clamped between the first edge and the first channel and the second conductor is clamped between the second edge and the second channel. Only when the first and second conductors are less than a predetermined size combination the first and second flanges are forced outwardly by the first and second bearing surfaces, respectively, so that the first and second channels are urged against the first and second conductors, respectively, with additional force.

DESCRIPTION OF THE PREFERRED EMBODIMENT

Figure 1:
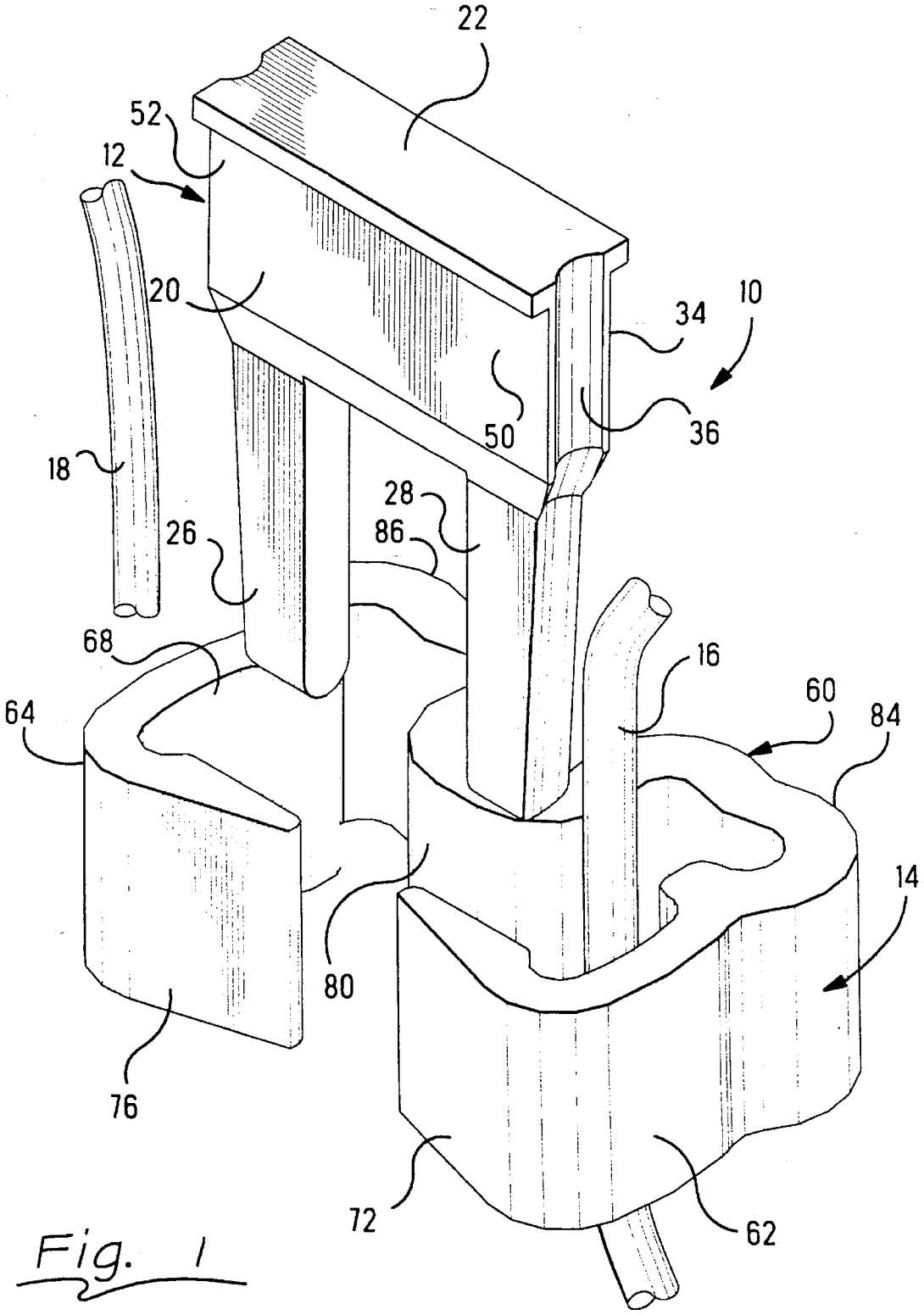
FIG. 1 is an isometric exploded parts view of an electrical wire connector incorporating the teachings of the present invention.
Figure 2:
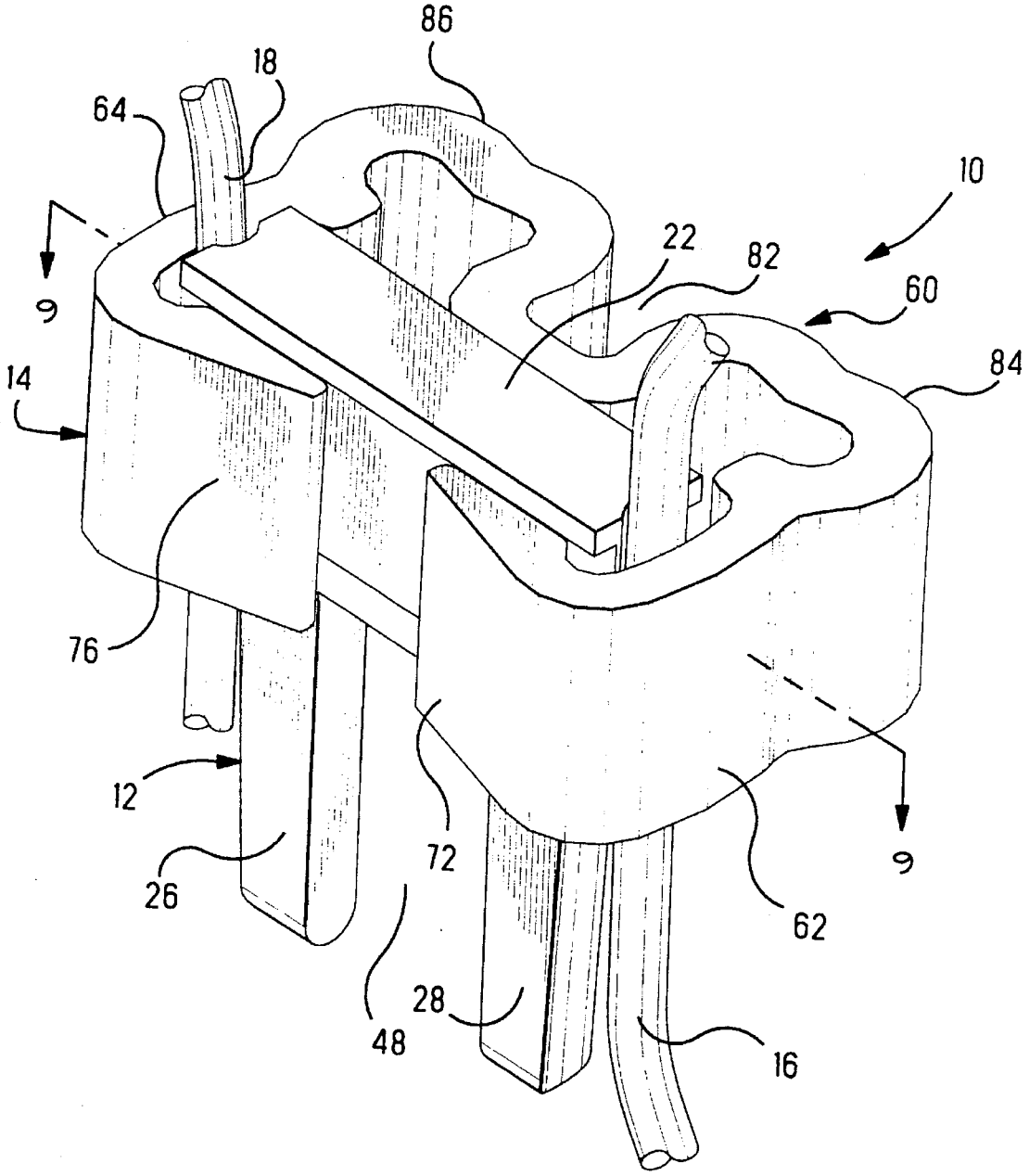
FIG. 2 Is an isometric view of the connector shown in FIG. 1, fully assembled.
Figure 4:
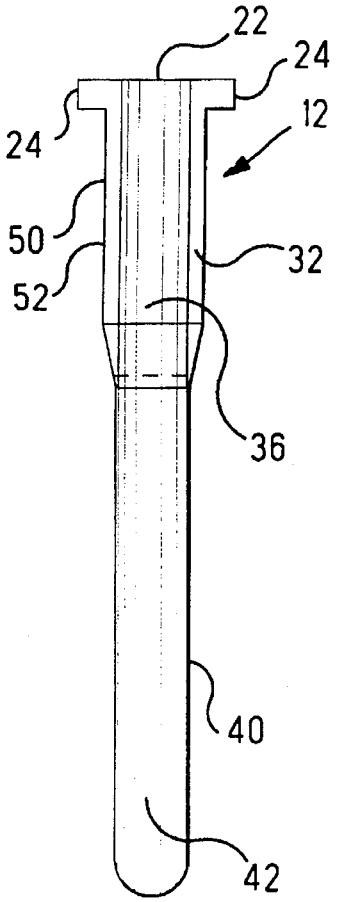
FIGS. 3, 4, and 5 are end, side, and front views, respectively, of the wedge of the connector shown in FIG. 1.
Figure 5:
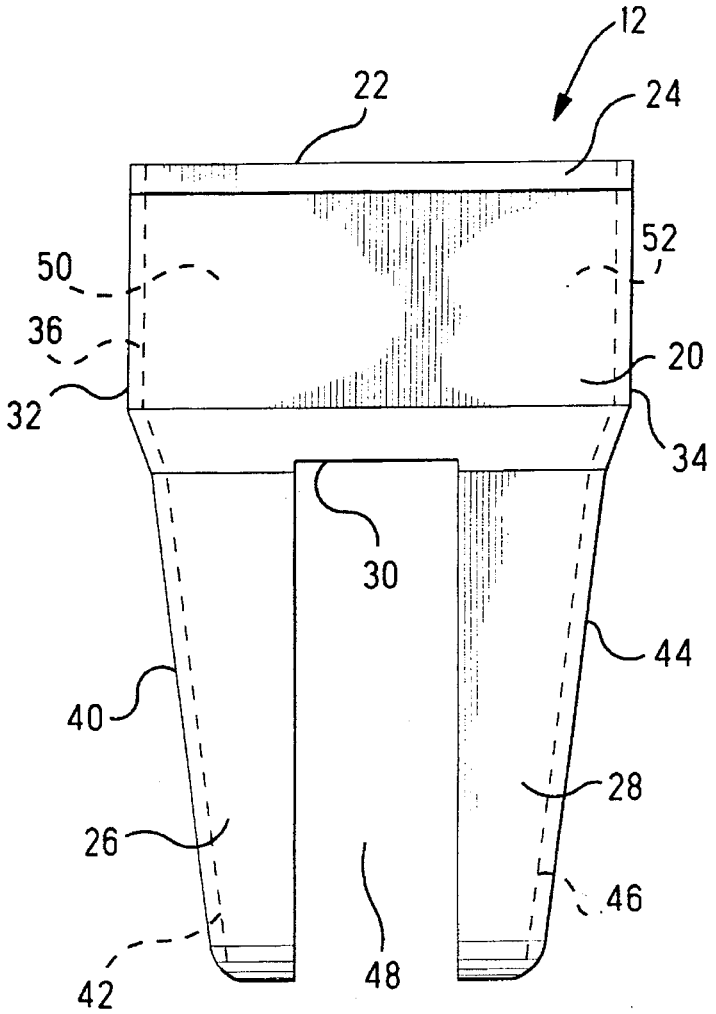
Figure 3:
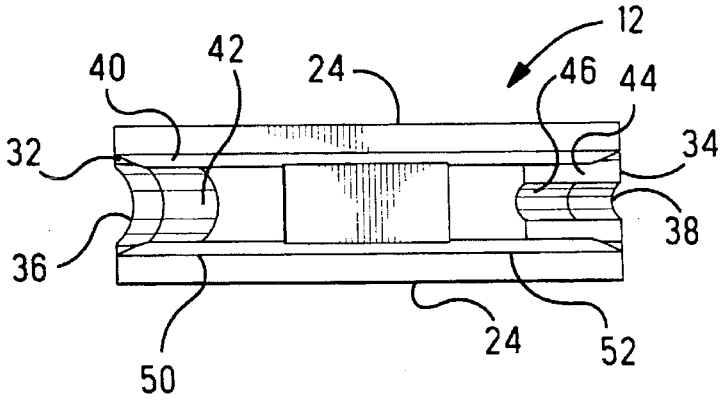

There is shown in FIGS. 1 and 2, an electrical wire connector 10 having a wedge 12 and a clamp member 14 arranged to receive the wedge to physically and electrically interconnect a first conductor 16 and a second conductor 18. The connector 10 is shown in FIG. 2 with the wedge 12 in its closed position in clamping engagement with the conductors 16 and 18. In the present example the first conductor 16 is a through conductor that delivers power to a region, such as a geographic area, and the second conductor is a tap conductor that supplies power to a local area within the geographic area. The wedge 12, as shown in FIGS. 3, 4, and 5, includes a body 20 of generally rectangular shape having an end 22 and a pair of flanges 24 extending outwardly from the end on opposite sides of the body. First and second guide arms 26 and 28, respectively, extend from an end 30 opposite the end 22 of the body 20. The body 20 includes first and second substantially parallel opposite edges 32 and 34 and concave surfaces 36 and 38, respectively. The first guide arm 26 includes a tapered edge 40 and concave surface 42 that blend in smoothly with the edge 52 and surface 36. Similarly, the second guide arm 28 includes a tapered edge 44 and concave surface 46 that blend in smoothly with the edge 34 and surface 38. Note that the two edges 40 and 44 and their respective concave surfaces 42 and 46 converge toward their free ends, while the two guide arms 26 and 28 form an opening 48 that extends from the end 30 to the free ends of the arms. The body 20 includes a first bearing surface 50 adjacent to and along the length of the first edge 32 and a second bearing surface adjacent to and along the length of the second edge 34. As will be explained below, these bearing surfaces, under certain circumstances, will be engaged by portions of the clamp member 14 when assembled.

Figure 8:
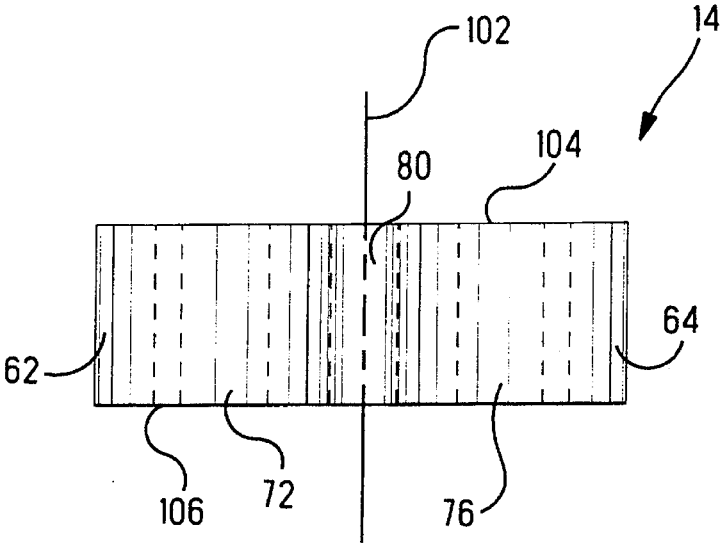
FIGS. 6, 7, and 8 are end, side, and front views, respectively, of the clamp member of the connector shown in FIG. 1.
Figure 6:
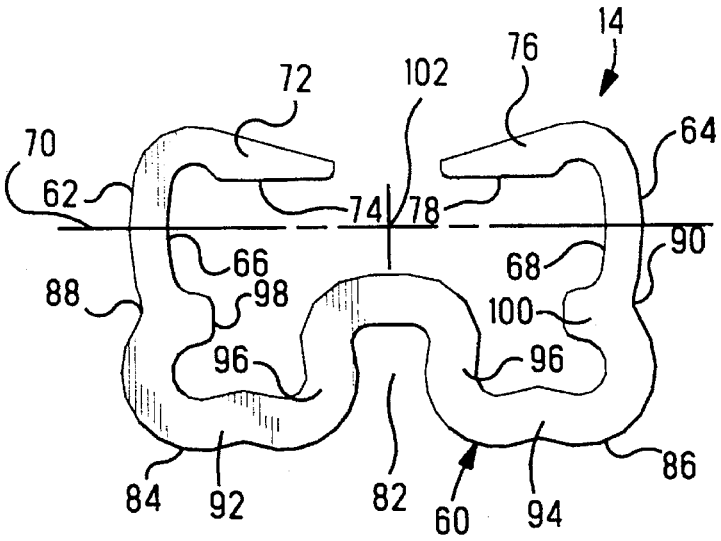
Figure 7:
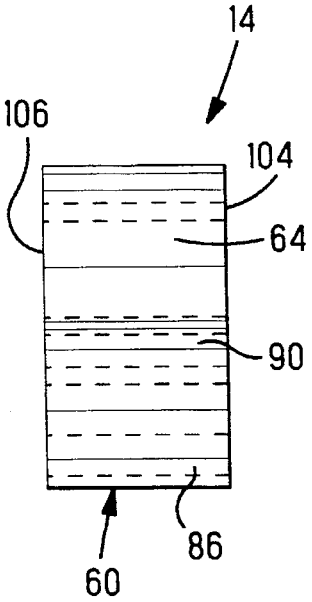

The clamp member 14, as shown in FIGS. 6, 7, and 8, includes a resilient intermediate portion 60 and first and second walls 62 and 64 extending from opposite sides thereof. A first channel 66 is formed in the first wall and a second channel 68 is formed in the second wall, the two channels being opposed, as best seen in FIG. 6. The clamp member 14 includes a cross-sectional horizontal axis 70 that extends through the centers of the first and second channels. A first flange 72 having a flange surface 74 extends from the first wall 62, substantially at right angles thereto, and a second flange 76 having a flange surface 78 extends from the second wall 64, substantially at right angles thereto. The two flange surfaces 74 and 78 define a plane that is substantially parallel to the axis 70. The intermediate portion 60 includes a central bight 80 projecting generally toward the two flanges 72 and 76 and forms a tool receiving groove 82 facing in the opposite direction, as best seen in FIG. 6. Left and right bights 84 and 86, respectively, project in a direction opposite that of the central bight. The left bight 84 has one side attached to the left side of the central bight 80 and the other side attached to the first wall 62 at a first junction 88. The right bight 86 has one side attached to the right side of the central bight 80 and the other side attached to the second wall 64 at a second junction 90. The central bight 80, right and left bights 84 and 86, the first and second walls 62 and 64, and the first and second flanges 72 and 76 are all formed integrally from a high strength aluminum alloy such as 6061-T6. The left and right bights 84 and 86 include elongated portions 92 and 94, respectively, that extend somewhat parallel to the axis 70, even though they are radiussed slightly to increase the total deflection range of the clamp member 14. Similarly, the sides 96 of the central bight 80 are radiussed slightly to increase the total deflection range of the clamp member. First and second guide rails 98 and 100 extend inwardly from the junctions 88 and respectively, toward the central bight 80. The guide rails are positioned at a distance from the axis 70 that is about equal to or slightly greater than the distance between the central bight 80 and the axis. The guide rails 98 and 100 serve to guide the wedge 12 as it is being inserted into the clamp member 14 to assure that the parts remain in proper alignment. As shown in FIG. 8, the clamp member 14 includes a longitudinal axis 102 that is midway between and parallel with the first and second channels 66 and 68 and that intersects the axis 70, as shown in FIG. 6. The two rails 98 and 100 as well as the three bights 80, 84, and 86 are all substantially parallel to the longitudinal axis 102. The clamp member 14 includes two opposite ends 104 and 106 that are perpendicular to the longitudinal axis 102. The intermediate portion 60 of the clamp member 14 has a cross-sectional thickness, in consideration with the various radiuses at 92, 94, and 96, that yields an approximately constant stress across the entire intermediate portion 60 through the full range of deflection of the clamp member 14, as will now be described.

Figure 9:
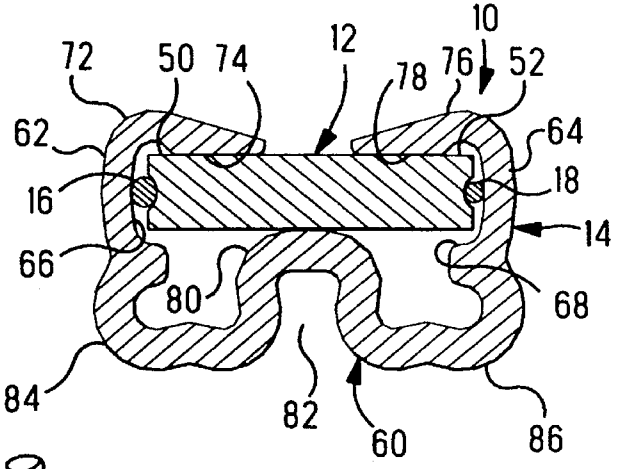
FIGS. 9, 10, and 11 are cross-sectional views taken along the lines 9—9 in FIG. 2, showing the connector in clamping engagement with conductors of various sizes.
Figure 10:
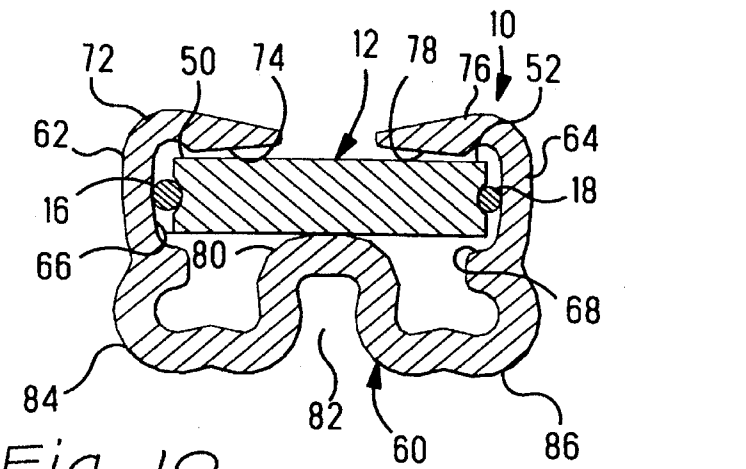
Figure 11:
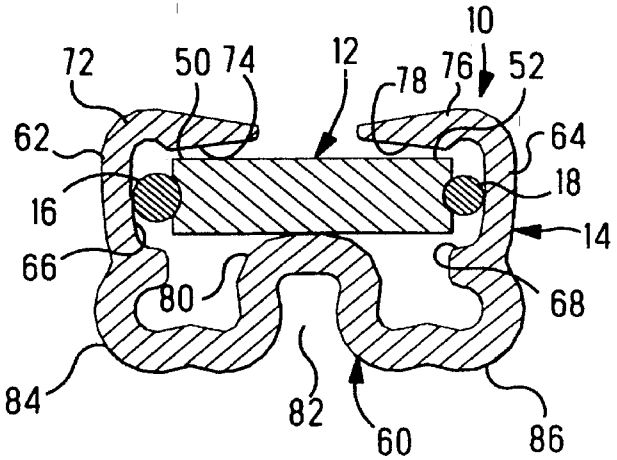

There is shown in FIGS. 9, 10, and 11, a cross section of the clamp member 14 with the wedge 12 in its closed position and with a range of different conductors of various diameters. To accommodate a full range of conductor sizes from 14 gage, 0.064 inch diameter, to 397 Kc mills, 0.783 inch diameter, requires seven different sized clamp members and associated wedges. The clamp member 14 and wedge 12 of the present example is the smallest of the seven and can accommodate various combinations of conductor sizes from 0.064 to 0.477 inch diameters, where the tap conductor 18 must be within the range of 0.064 to 0.255 and the through conductor 16 must be within the range of 0.128 to 0.477. That is, any tap conductor 18 within the range of 0.064 to 0.255 will be accommodated by the wire connector 10 in combination with any through conductor 16 within the range 0.128 to 0.477. To accommodate these different size conductors, the clamp member 14 has a working range of deflection of about 0.540 inch that is illustrated by the variation in deflection shown in FIG. 9 to FIG. 11. That is, the first and second channels 66 and 68 become further apart as the clamp member deflects outwardly. This deflection outwardly is about 0.100 for the minimum sized conductors to an additional maximum amount of movement of 0.550 inch for the largest sized conductors. As shown in FIG. 9, the connector 10 is in clamping engagement with a through conductor 16 and a tap conductor 18, both of minimal size. This results in minimal deflection of the clamp member 14 which also results in minimal clamping force on the conductors due to this smaller deflection. However, the thickness of the wedge 12 is chosen so that the bearing surfaces 50 and 52 of the wedge 12 push upwardly against the flange surfaces 74 and 78, respectively, causing the first and second walls 62 and 64 to tend to deflect inwardly toward the wedge, thereby increasing the clamping force against the conductors 16 and 18. As shown in FIG. 10, the conductors 16 and 18 are somewhat larger than the conductors shown in FIG. 9, thereby causing the clamp member 14 to deflect outwardly an additional amount. In this case the first and second flanges 72 and 76 are canted slightly due to the pivoting action of the walls 62 and 64 as the clamp member 14 is further deflected. This canting causes the flanges to move upwardly very slightly, as viewed in FIG. 10, so that the first and second bearing surfaces 50 and 52 of the wedge 12 engage only the edges of the flange surfaces 74 and 78, respectively, and push upwardly a lesser amount than in the case of FIG. 9, causing the first and second walls 62 and 64 to tend to deflect inwardly toward the wedge, thereby increasing the clamping force against the conductors 16 and 18 only slightly. As shown in FIG. 11, the conductors 16 and 18 are larger than the conductors shown in FIG. 10, thereby causing the clamp member 14 to deflect outwardly an additional amount. In this case the first and second flanges 72 and 76 are canted much more than in the case of Figure 10 by the pivoting action of the walls 62 and 64 as the clamp member 14 is further deflected. As shown in FIG. 11, the flange surfaces 74 and 78 are now spaced from the bearing surfaces 50 and 52 so that there is no increased clamping force against the conductors 16 and 18 due to the first and second flanges. Therefore, any further increase in conductor sizes will result in the flanges moving further away from the bearing surfaces, and the clamping force on the conductors will derive solely from the elastic deflection of the intermediate portion 60 of the clamp member 14.

Figure 12:
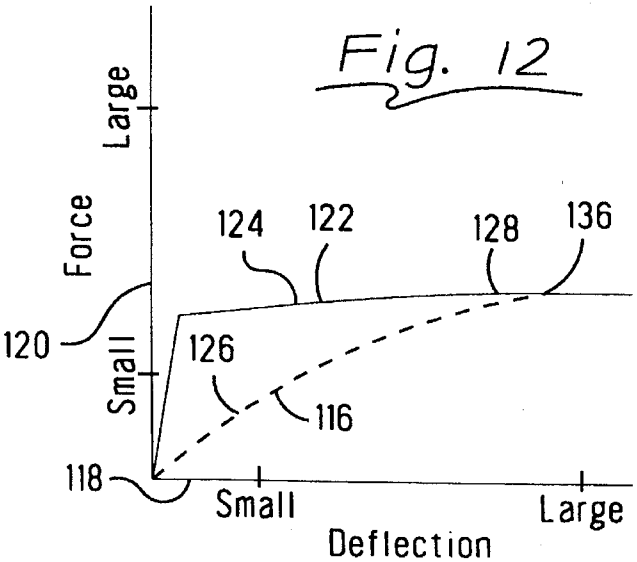
FIG. 12 is a graph containing two curves depicting the relationship of clamp member deflection with respect to the clamping force on the conductors.

The clamping force caused by the sole elastic deflection of the intermediate portion 60 of the clamp member 14 is depicted by the curve 116 of the graph shown in FIG. 12. The horizontal axis 118 of the graph represents the amount of deflection of the clamp member 14 and the vertical axis 120 represents the amount of the clamping force on the conductors 16 and 18 as a result of the deflection. As is shown there, the clamping force starts at substantially zero and increases proportionately with the increase in deflection. This means that conductors of smaller diameters would be clamped in the wire connector with substantially less force than would be conductors of larger diameters. However, the action of the flanges 72 and 76, as described above in conjunction with FIGS. 9 and 10, provides additional clamping force for the smaller conductors and correspondingly less additional clamping force for larger conductors. This additional clamping force, when added to the clamping force solely due to deflection of the clamp member 14, is depicted by the curve 122 of the graph in FIG. 12. The smaller conductors, as in the case of FIG. 9, would receive a total clamping force as shown at 124 on the curve 122, where without the benefit of the flanges 72 and 76, the total clamping force would be substantially less as shown at 126 on the curve 116. As the conductor sizes increase to that shown in FIG. 10, the total clamping force correspondingly increases to that shown at 128 on the curve 122. As the conductor sizes increase more, the bearing surfaces 50 and 52 are no longer pushing upwardly on the flanges 72 and 76 so that the total clamping force is the same as the clamping force due solely to deflection of the clamp member 14. This point is indicated in the graph at 130 where the two curves 116 and 122 cross. The net result of the two sources of clamping force, as illustrated by the curve 122, is that the total clamping force on the conductors 16 and 18 is somewhat constant for the full range of conductor sizes that the wire connector 10 will accommodate.

Figure 13:
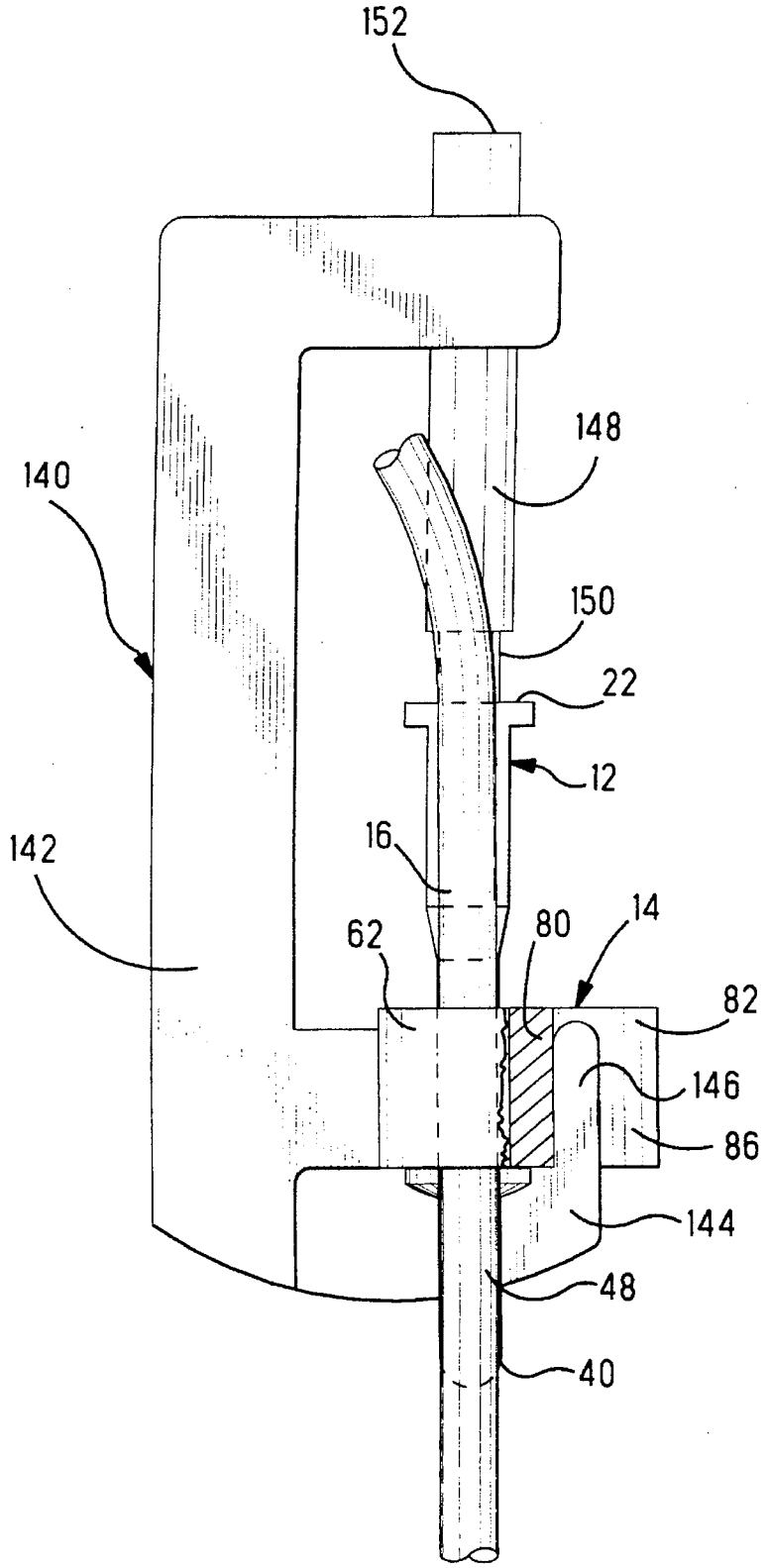
FIG. 13 is a side view showing the wire connector in a power assist tool.

The wedge 12 may be assembled to the clamp member 14 by means of a power assist tool. While there are several different types of power assist tools commercially available for use with this connector, a general tool 140 is schematically depicted in FIG. 13. The conductors 16 and 18 are arranged in their respective first and second channels and the wedge 12 partially inserted into the clamp member 14 along the axis 102, and the entire assembly inserted into the tool 140, as shown in FIG. 13. The tool 140 includes a frame 142 having a nest 144 for holding the clamp member 14. An alignment finger 146 extends from the nest 144 downwardly through the opening 48 and into the tool receiving groove 82 formed by the central bight 80 in the clamp member 14 for positioning the clamp member properly within the tool. The width of the opening 82 is similar for all of the different sized clamp members so that a single power assist tool can be used to assemble all of the different sized wire connectors 10. A cartridge chamber 148 is at one end of the tool and includes a piston 150 in engagement with the end 22 of the wedge 12. By striking the end 152 of the cartridge chamber, the cartridge is discharged, driving the piston 150 to the left, as viewed in FIG. 13, until the wedge is fully inserted into the clamp member, as shown in FIG. 2. It will be understood that the cartridge powered tool 140 is by way of example only and that other suitable power assist tool using compressed air, hydraulic fluid, or other means may be utilized to assemble the connector 10.

An important advantage of the present invention is that a wide range of conductor combinations can be accommodated in a single wire connector so that a relative small number of connectors of different sizes is required to cover the full range of conductors. Additionally, The clamping force on the conductors is relatively independent of the sizes of the conductors resulting in a more reliable connection. A relatively higher clamping force for the smaller conductors is achieved resulting in higher retention and pullout forces, and less contact resistance over conventional wire connectors. Because the tool receiving groove is the same size for all of the wire connectors, a single power assist tool can be utilized for all connectors.

We claim:

1. An electrical wire connector for electrically and physically connecting two conductors together comprising:

(a) a clamp member having a resilient intermediate portion, two inwardly facing opposed first and second channels formed in first and second walls, respectively, said walls extending from opposite sides of said intermediate portion, and first and second flanges attached to said first and second walls, respectively, opposite said intermediate portion;

(b) a wedge having first and second opposite edges, a first bearing surface adjacent said first edge, and a second bearing surface adjacent said second edge, wherein said wedge is to be conformably received in a closed position between said first and second channels of said clamp member where said first and second opposite edges are in opposed relationship with said first and second channels for clamping first and second conductors therebetween, respectively, so that when moving said wedge into engagement with said first and second conductors and into said closed position within said clamp member, said first and second channels are cammed outwardly against the urging of said resilient intermediate portion thereby applying a clamping force on said first and second conductors so that said first conductor is clamped between said first edge and said first channel and said second conductor is clamped between said second edge and said second channel, and only when said first and second conductors are less than a predetermined size combination said first and second flanges are forced outwardly by said first and second bearing surfaces, respectively, so that said first and second channels are urged against said first and second conductors, respectively, with additional force.

2. The wire connector according to claim 1 including a first guide rail extending from said first junction toward said central bight and a second guide rail extending from said second junction toward said central bight, said first and second guide rails arranged to guide said wedge when moving it into engagement with said first and second conductors and into said closed position within said clamp member.

3. The wire connector according to claim 1 wherein said intermediate portion includes a cross-sectional profile having substantially equal stress along its entire length when said wedge is in said closed position.

4. The wire connector according to claim 1 wherein said first and second flanges interact with said first and second bearing surfaces, respectively, so that the clamping force on said first and second conductors by said clamp member and said wedge is substantially constant for a predetermined range of conductor sizes.

5. The wire connector according to claim 1 wherein when said wedge is in said closed position said first bearing surface is opposed to said first flange and said second bearing surface is opposed to said second flange.

6. The wire connector according to claim 5 wherein said intermediate portion includes:

a central bight projecting in a direction generally toward said first and second flanges, said central bight forming a tool receiving groove facing in an opposite direction;

a left bight projecting in said opposite direction, one side of which is attached to a left side of said central bight and another side of which is attached to said first wall at a first junction; and a right bight projecting in said opposite direction, one side of which is attached to a right side of said central bight and another side of which is attached to said second wall at a second junction.

7. The wire connector according to claim 6 wherein said clamp member includes a cross-sectional horizontal axis that extending through said first and second channels and wherein each of said left and right bights includes an elongated portion arranged somewhat parallel to said axis.

8. The wire connector according to claim 7 wherein said central bight, said right bight, and said left bight are radiussed slightly to increase the total deflection range of said clamp member.

9. The wire connector according to claim 7 wherein said first and second flanges have flange surfaces defining a plane that is substantially parallel with said horizontal axis when said wedge is not in said closed position.

* * * * *